US006822539B2

(12) United States Patent
Saito et al.

(10) Patent No.: US 6,822,539 B2
(45) Date of Patent: Nov. 23, 2004

(54) DIELECTRIC RESONANCE DEVICE WITH STABILIZED ELECTRIC PERFORMANCE

(75) Inventors: Shuji Saito, Miyagi-ken (JP); Yasuo Yamaki, Fukushima-ken (JP); Susumu Nakajima, Fukushima-ken (JP); Masahiko Nakatsugawa, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 68 days.

(21) Appl. No.: 10/300,280

(22) Filed: Nov. 20, 2002

(65) Prior Publication Data

US 2003/0098763 A1 May 29, 2003

(30) Foreign Application Priority Data

Nov. 28, 2001 (JP) ..... 2001-362244

(51) Int. Cl.[7] ..... H01P 7/00; H01P 7/10
(52) U.S. Cl. ..... 333/219; 333/219.1
(58) Field of Search ..... 333/219, 219.1

(56) References Cited

U.S. PATENT DOCUMENTS 5,200,721 A * 4/1993 Mansour ..... 333/202

FOREIGN PATENT DOCUMENTS

| | | | | |
|---|---|---|---|---|
| EP | 0 419 938 B2 | | 4/1991 | |
| JP | 07-142911 | | 6/1995 | |
| JP | 1010326 A | * | 7/1998 | ..... H01P/7/10 |
| JP | 2000244214 A | * | 9/2000 | ..... H01P/7/10 |
| JP | 2000286634 | | 10/2000 | |
| JP | 2001156670 | | 6/2001 | |
| JP | 2003124715 A | * | 4/2003 | ..... H01P/7/10 |

* cited by examiner

*Primary Examiner*—Robert Pascal
*Assistant Examiner*—Kimberly Glenn
(74) *Attorney, Agent, or Firm*—Brinks Hofer Gilson & Lione

(57) ABSTRACT

The dielectric resonance device according to the present invention is constructed such that there are provided a column-shaped dielectric resonator and a column-shaped pedestal bonded to the undersurface of the dielectric resonator with the adhesive, for supporting the dielectric resonator, that on the joint surface between the pedestal and the dielectric resonator, there is provided an adhesive collecting recess so as not to reach a side of the pedestal, and that the joint surface and the undersurface of the dielectric resonator are bonded to each other with the adhesive. Therefore, the recess serves as a place for collecting the adhesive so that the adhesive which is squeezed out from between the joint surface and the undersurface of the dielectric resonator can be eliminated, making it possible to provide a dielectric resonance device with stabilized electric performance.

3 Claims, 2 Drawing Sheets

DIELECTRIC RESONANCE DEVICE WITH STABILIZED ELECTRIC PERFORMANCE

BACKGROUND OF THE INVENTION

1. Field of the Invention

The present invention relates to a dielectric resonance device suitable for use in a converter for receiving satellite broadcasting, and the like.

2. Description of the Prior Art

With reference to FIG. 5, the description will be made of structure of a conventional dielectric resonance device. A dielectric resonator 51 made of a ceramic material is formed in a cylindrical column shape, and an undersurface 51*a* thereof is formed into a flat surface.

A pedestal 52 made of a ceramic material or the like is formed into a column shape such as a cylindrical column shape having a diameter smaller than that of the dielectric resonator 51, and has a joint surface 52*a* made up of a flat surface located in the upper part, and a protrusion 52*c* protruding downward from the central portion of a lower part 52*b*.

Thus, by pressing the undersurface 51*a* of the dielectric resonator 51 against the joint surface 52*a* in a state in which an adhesive 53 has been provided on the joint surface 52*a*, the dielectric resonator 51 is bonded to the pedestal 52.

At this time, a state is brought about in which the adhesive 53 is squeezed out from between the joint surface 52*a* and the undersurface 51*a*.

Also, the pedestal 52 to which the dielectric resonator 51 has been bonded is placed on a mounting member 54 made up of a circuit substrate or the like, and both are positioned by fitting the protrusion 52*c* into a hole 54*a* provided in the mounting member 54. In such a positioned state, the pedestal 52 is mounted to the mounting member 54.

In the conventional dielectric resonance device, since the flat undersurface 51*a* of the dielectric resonator 51 is bonded to the flat joint surface 52*a* of the pedestal 52 with the adhesive 53, the adhesive 53 is squeezed out from between the joint surface 52*a* and the undersurface 51*a*, and this leads to a problem of deteriorated performance such as frequency drift and Q-value reduction.

SUMMARY OF THE INVENTION

It is an object of the present invention to provide a dielectric resonance device with stabilized electric performance without any adhesive being squeezed out.

In order to solve the above-described problem, as first solution means, the structure is arranged such that there are provided a column-shaped dielectric resonator and a column-shaped pedestal bonded to the undersurface of the dielectric resonator with the adhesive, for supporting the dielectric resonator, that on a joint surface between the pedestal and the dielectric resonator, there is provided an adhesive collecting recess so as not to reach a side of the pedestal, and that the joint surface and the undersurface of the dielectric resonator are bonded to each other with the adhesive.

Also, as second solution means, the structure is arranged such that the recess is provided in a central portion of the joint surface.

Also, as third solution means, the structure is arranged such that the joint surface and the undersurface of the dielectric resonator are bonded to each other in a state in which the adhesive has been provided on the joint surface located in vicinity of the recess.

Also, as fourth solution means, the structure is arranged such that the recess is formed in an annular shape leaving an island-shaped portion in the central portion of the joint surface.

Also, as fifth solution means, the structure is arranged such that the island-shaped portion, which is the joint surface, is bonded to the undersurface of the dielectric resonator in a state in which an adhesive has been provided on the island-shaped portion.

DETAILED DESCRIPTION OF THE PREFERRED EMBODIMENTS

Figure 1:
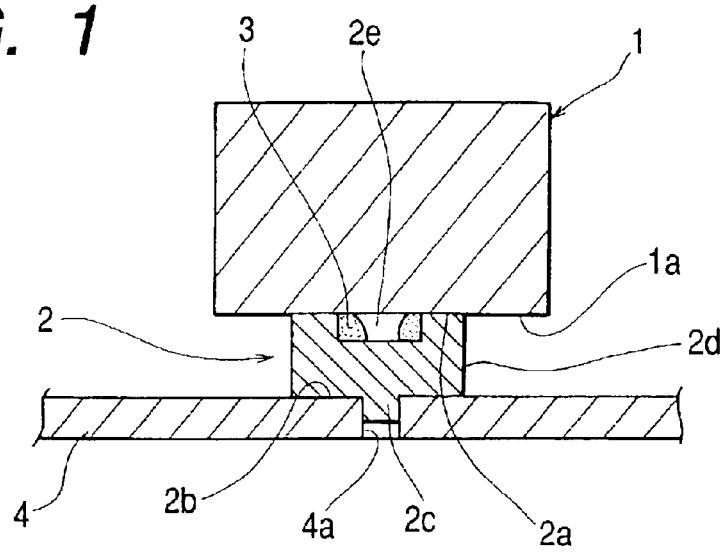
FIG. 1 is a cross sectional view showing a principal portion of a dielectric resonance device according to a first embodiment of the present invention.
Figure 2:
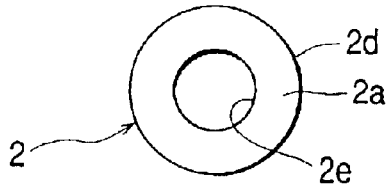
FIG. 2 is a plan view showing a pedestal of the dielectric resonance device according to the first embodiment of the present invention.
Figure 3:
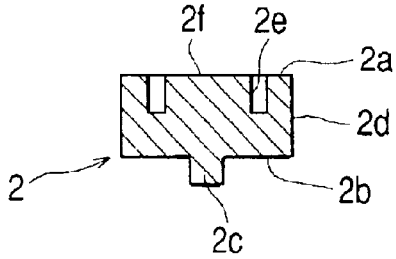
FIG. 3 is a cross sectional view showing a pedestal of the dielectric resonance device according to a second embodiment of the present invention.
Figure 4:
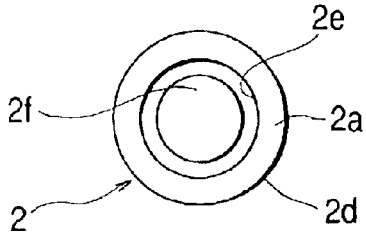
FIG. 4 is a plan view showing the pedestal of the dielectric resonance device according to the second embodiment of the present invention.
Figure 5:
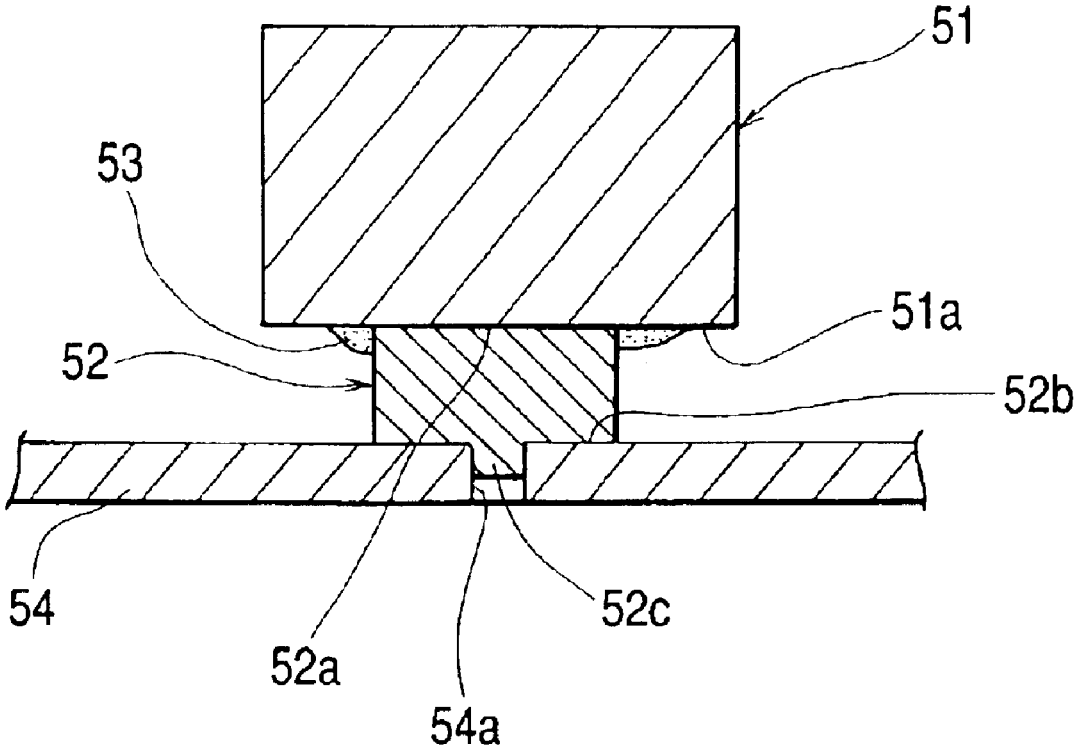
FIG. 5 PRIOR ART
FIG. 5 is a cross sectional view showing a principal portion of a conventional dielectric resonance device.

The drawings of the dielectric resonance device according to the present invention will be described. FIG. 1 is a cross sectional view showing a principal portion of a dielectric resonance device according to the first embodiment of the present invention, FIG. 2 is a plan view showing a pedestal of the dielectric resonance device according to the first embodiment of the present invention, FIG. 3 is a cross sectional view showing the pedestal of the dielectric resonance device according to a second embodiment of the present invention, and FIG. 4 is a plan view showing the pedestal of the dielectric resonance device according to the second embodiment of the present invention.

Next, with reference to FIGS. 1 and 2, the description will be made of the structure of the dielectric resonance device according to the first embodiment of the present invention. A dielectric resonator 1 made of a ceramic material is formed in a cylindrical column shape, and an undersurface 1*a* thereof is formed into a flat surface.

A pedestal 2 made of a ceramic material or the like is formed into a column shape such as a cylindrical column shape having a diameter smaller than that of the dielectric resonator 1, and has a joint surface 2*a* made up of a flat surface located in the upper part, a protrusion 2*c* protruding downward from the central portion of the lower part 2*b*, and a recess 2*e* provided in the central portion of the joint surface 2*a* so as not to reach a side 2*d*.

By pressing the undersurface 1*a* of the dielectric resonator 1 against the joint surface 2*a* in a state in which an adhesive 3 has been provided on the joint surface 2*a* located in the vicinity of the recess 2*e*, the dielectric resonator 1 is bonded to the pedestal 2.

At this time, the adhesive 3 provided on the joint surface 2*a* shifts into the recess 2*e* and the recess 2*e* serves as a place for collecting the adhesive so that an amount of the adhesive 3 which is squeezed out from between the joint surface 2*a* and the undersurface 1*a* can be decreased or eliminated.

Also, the pedestal 2 to which the dielectric resonator 1 has been bonded is placed on a mounting member 4 made up of a circuit substrate or the like, and both are positioned by fitting the protrusion 2*c* into a hole 4*a* provided in the mounting member 4. In such a positioned state, the pedestal 2 is mounted to the mounting member 4.

Also, FIGS. 3 and 4 show the second embodiment of the present invention, and in this second embodiment, a recess 2*e* provided on the joint surface 2*a* of the pedestal 2 is formed in an annular shape (ring shape) by leaving an island-shaped portion 2*f* in the central portion of the joint surface 2*a*.

Thus, in a state in which the adhesive 3 has been provided on the island-shaped portion 2*f*, the island-shaped portion 2*f*, which is the joint surface 2*a*, and the undersurface 1*a* of the dielectric resonator 1 are bonded to each other. For this reason, the adhesive 3 which is squeezed out from the island-shaped portion 2*f* is reliably collected in the annular recess 2*e*, and there is no possibility that the adhesive 3 is squeezed out from the pedestal 2.

The present embodiment is similar to the above-described first embodiment in the rest of the structure, identical components are designated by the identical reference numerals, and a description thereof will be omitted here.

The dielectric resonance device according to the present invention is constructed such that there are provided a column-shaped dielectric resonator and a column-shaped pedestal bonded to the undersurface of this dielectric resonator with the adhesive, for supporting the dielectric resonator, that on the joint surface between the pedestal and the dielectric resonator, there is provided an adhesive collecting recess so as not to reach the side of the pedestal, and that the joint surface and the undersurface of the dielectric resonator are bonded to each other with the adhesive. Therefore, the recess serves as a place for collecting the adhesive so that the amount of the adhesive which is squeezed out from between the joint surface and the undersurface of the dielectric resonator can be decreased or eliminated, making it possible to provide a dielectric resonance device with stabilized electric performance.

Also, since the recess has been provided in the central portion of the joint surface, it is possible to provide a dielectric resonance device simple in structure without any adhesive being squeezed out.

Also, since in a state in which the adhesive has been provided on the joint surface located in the vicinity of the recess, the joint surface is bonded to the undersurface of the dielectric resonator, it is possible to reliably prevent the adhesive from being squeezed out, and to provide a dielectric resonance device with stabilized electric performance.

Also, since the recess is formed in an annular shape leaving an island-shaped portion in the central portion of the joint surface, it is possible to provide a dielectric resonance device simple in structure without any adhesive being squeezed out.

Also, since in a state in which the adhesive has been provided on the island-shaped portion, the island-shaped portion, which is the joint surface, and the undersurface of the dielectric resonator are bonded to each other, it is possible to reliably prevent the adhesive from being squeezed out, and to provide a dielectric resonance device with stabilized electric performance.

What is claimed is:

1. A dielectric resonance device comprising: a column-shaped dielectric resonator having a flat undersurface; and a column-shaped pedestal bonded to the undersurface of the dielectric resonator with an adhesive, that supports the dielectric resonator, wherein on a joint surface between the pedestal and the dielectric resonator, there is provided an adhesive collecting recess disposed between a side surface of the pedestal and a central axis of the pedestal, the recess not communicating directly with the side surface, and wherein the joint surface and the undersurface of the dielectric resonator are bonded to each other with the adhesive.

2. The dielectric resonance device according to claim 1, wherein the recess is formed in an annular shape leaving an island-shaped portion including the central axis of the joint surface.

3. The dielectric resonance device according to claim 2, wherein in a state in which an adhesive has been provided on the island-shaped portion, the island-shaped portion, which is the joint surface, is bonded to the undersurface of the dielectric resonator.

* * * * *

UNITED STATES PATENT AND TRADEMARK OFFICE

CERTIFICATE OF CORRECTION

PATENT NO. : 6,822,539 B2
DATED : November 23, 2004
INVENTOR(S) : Shuji Saito et al.

It is certified that error appears in the above-identified patent and that said Letters Patent is hereby corrected as shown below:

Title page,
Item [56] References Cited, U.S. PATENT DOCUMENTS, insert the following.
-- 5,525,075 6/1996 Michisita et al. --

Column 2,
Line 2, delete "1010326" and substitute -- 10190326 -- in its place.

Signed and Sealed this

Thirty-first Day of May, 2005

JON W. DUDAS
*Director of the United States Patent and Trademark Office*